United States Patent [19]

Schwarzmann

[11] 4,238,745

[45] Dec. 9, 1980

[54] PHASE SHIFTER

[75] Inventor: Alfred Schwarzmann, Mt. Laurel, N.J.

[73] Assignee: RCA Corporation, New York, N.Y.

[21] Appl. No.: 49,583

[22] Filed: Jun. 18, 1979

[51] Int. Cl.[3] ..... H01P 1/185; H01P 3/08; H01P 9/00

[52] U.S. Cl. ..... 333/164; 333/161; 333/35; 333/246

[58] Field of Search ..... 33/156, 157, 160, 164, 33/33, 35, 245–247

[56] References Cited

U.S. PATENT DOCUMENTS

| | | | |
|---|---|---|---|
| 3,568,105 | 3/1971 | Felsenheld | 333/161 |
| 4,105,959 | 8/1978 | Stachejko | 333/164 |
| 4,160,220 | 7/1979 | Stachejko | 333/161 |

*Primary Examiner*—Marvin L. Nussbaum

*Attorney, Agent, or Firm*—Samuel Cohen; Robert L. Troike

[57] ABSTRACT

A phase shifter comprises a segment of transmission line and a reentrant transmission path segment. Each phase shift "bit" utilizes only a pair of diodes to switch in a transmission path which provides the desired phase shift. The phase shifter is of relatively small size and is relatively inexpensive.

14 Claims, 3 Drawing Figures

PHASE SHIFTER

The present invention generally relates to phase shifters and, in particular, relates to a diode phase shifter comprising a reentrant network which can be electronically switched to introduce a phase shift in the path of an electromagnetic signal.

Many modern radars are designed to be stationary and to electronically scan a preselected spatial volume. Such radars are generally known as phased array radars and comprise a plurality of transmit/receive antenna elements. The transmit/receive direction of each of these elements, either individually or as small subarrays, is controlled by a phase shifter. Hence each phased array radar includes a plurality of phase shifters. These phase shifters, in addition to being the steering control of the radar, are a major factor in its ultimate cost and size.

Of the two generally used types of phase shifters, i.e., ferrite phase shifters and diode phase shifters, only the diode phase shifter is of interest herein. A diode phase shifter usually comprises a plurality of incremental phase shifts, known as bits, each of which introduces a preselected phase change into a path of a propagating electromagnetic signal. Usually the phase change is provided by introducing a longer alternative path to a segment of a main transmission line. Conventionally, this arrangement requires the use of at least two diodes at each end of the alternative path, i.e. four diodes per bit.

A novel phase shifter embodying the principles of the present invention reduces the number of diodes per bit by the use of a reentrant network. The reentrant network can be switched to a condition where it introduces a phase shift in a signal propagating through the phase shifter.

In the drawing, which is not drawn to scale:

Figure 1:
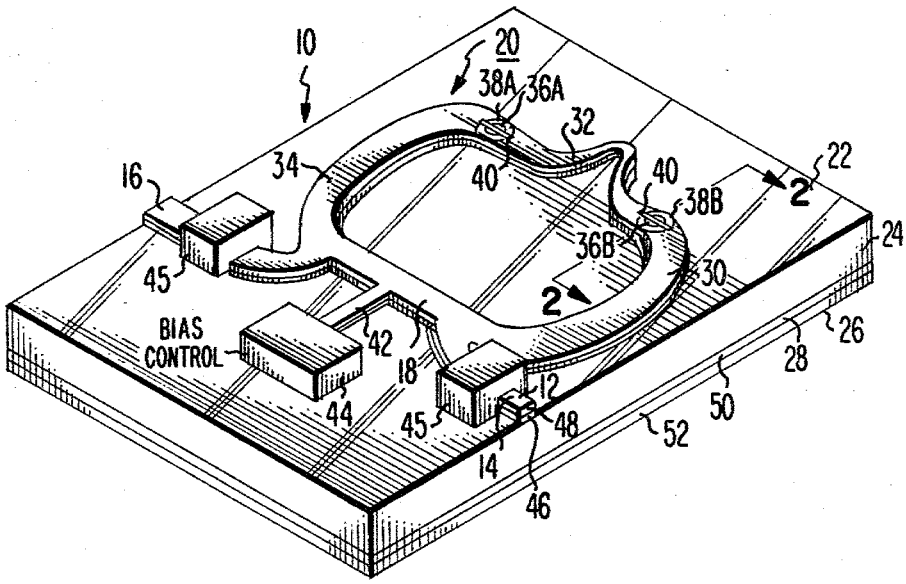
FIG. 1 is a perspective view of a phase shifter embodying the principles of the present invention.

Referring to FIG. 1, the phase shifter 10 is shown in microstrip form, although it could instead be fabricated utilizing coaxial cables, or the like. The phase shifter 10 includes a main transmission line 12 having an input section 14 of transmission line and a second section 16 of transmission line which may serve as an output section. In addition, the phase shifter 10 includes a third section 18 of main transmission line coupling the input section 14 to the second section 16. The phase shifter 10 further includes a reentrant network 20 which can be electronically switched into or out of the main transmission line 12. The reentrant network 20 is coupled between the input section 14 and the second section 16 of the main transmission line 12, that is, it is in shunt with the third section 18. The main transmission line 12 and the reentrant network 20 are formed on one surface 22 of an electrically insulating substrate 24. In addition, a ground plane 26 is formed on an opposite, parallel surface 28 of the substrate 24. Preferably, the ground plane 26 comprises two layers, one 50 of molybdenum and the other layer 52 of gold.

Figure 2:
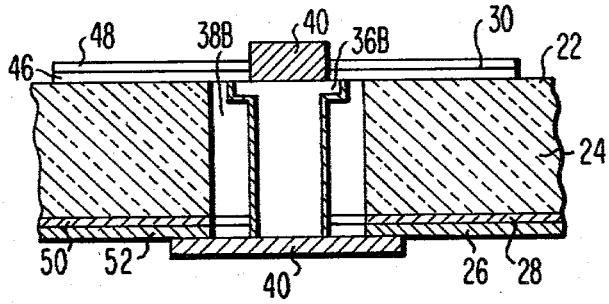
FIG. 2 is a partial cross-sectional view of the phase shifter of FIG. 1, taken along the line 2—2 thereof.

The reentrant network 20 comprises first, second and third transmission paths, 30, 32 and 34, respectively, and a pair of diodes 36A and 36B which preferably are matched diodes. The diodes 36A and 36B are similarly mounted and FIG. 2 shows some of the structural details, for clarity the internal structure and shading of the diode 36B is omitted. Referring to FIG. 2, diode 36B is located in an opening 38B in substrate 24 and is connected at one of its electrodes to the ground plane 26 by means of a conductor such as a gold or copper strip 40. The diode 36B is connected at its other electrode by a similar gold strip 40 to the end of the first transmission path 32. The other diode 36A is located in another opening 38A in the substrate 24 and is connected in similar fashion at one electrode to the ground plane 26 and at the other electrode to the end of the third transmission path 34 and the other end of the second transmission path 32. The diodes 36A and 36B are similarly poled, that is, either both anodes are connected to the ground plane 26 and both cathodes to the ends of the transmission path or vice-versa. A bias voltage source 44 supplies a D.C. bias voltage to the diodes 36A and 36B over D.C. bias line 42. This bias voltage is isolated from the input section 14 and the second section 16 by blocking capacitors 45 between the respective ends of these paths and the third section 18.

In one practical design of the embodiment of FIG. 1, the main transmission line 12 has an impedance of about 50 ohms which is conventional for microwave microstrip circuits. Preferably, the first and third transmission paths, 30 and 34 respectively, of the reentrant network 20 are connected to the main transmission line 12 at opposite ends of the third section 18 thereof. The second transmission path 32 of the reentrant network 20 is connected between the ends of the first and third transmission paths 30 and 34 respectively, which are distal from the third section 18. To assure power, or impedance matching to reduce energy reflections at the input section, the third section 18 and the first and third transmission paths 30 and 34 respectively, are about one quarter wavelength long of the center frequency $f_0$ or an odd integer multiple thereof.

The remainder of the parameters of the phase shifter 10 are dependent upon the desired phase shift thereof, that is, the $\Delta\phi$. For this example the phase shifter 10 will be considered to be a 45° bit i.e. $\Delta\phi=45°$. The next parameter needed to determine the impedance of the paths, 30, 32 and 34 of the reentrant network 20 is the phase shift contributed by the diodes, i.e. the $\Delta\phi_D$. This parameter can be determined by direct measurement of the diode. One particular method of measuring the $\Delta\phi_D$ of a diode is to connect the diode between the end of a 50 ohm transmission line and a ground plane and using known methods measure the phase angle in each of the diode's states, i.e. when it is open and when it is shorted. The difference between these phase angles is the phase shift of the diode, $\Delta\phi_D$ at the center frequency $f_0$. For consistancy within the phase shifter 10, it is preferred that the diodes 36A and 36B have substantially the same $\Delta\phi_D$. One particular diode which was used, the UM4000 Series manufactured and marketed by Unitrode Corporation, has a $\Delta\phi_D$ equal to about 45°. Since the ratio of $\Delta\phi$ to $\Delta\phi_D$ is used throughout the computations used hereinafter this ratio will be designated as a constant "K", i.e. $K=\Delta\phi/\Delta\phi_D$. In this example, $K=1$.

Having determined the constant K, the impedance of the first and third transmission paths, 30 and 34 respectively, of the reentrant network 20 is determined by the formula:

$$Z_{1,3}=Zm\sqrt{K/2}$$

where:

$Z_{1,3}$ is the impedance of the first and third transmission paths, 30 and 34 respectively; and Zm is the impedance of the main transmission line 12.

For the example where Zm=50 ohms, $\Delta\phi=45°$ and $\Delta\phi_D=45°$, $Z_{1,3}$ is equal to about 35 ohms.

The impedance and length of the second transmission path 32 of the reentrant network 20 are related via the formula:

$$Zm=(Z_2\omega_0 l/K\nu)=50$$

wherein:

Zm is the impedance of the main transmission line;

$Z_2$ is the impedance of the second transmission path 32;

$\omega_0$ is equal to $2\pi f_0$ where $f_0$ is the center frequency of 3.3 GHz of the phase shifter 10;

l is the physical length in microstrip of the second transmission path 32; and $\nu$ is the propagation velocity of an electromagnetic wave in the medium.

The propagation velocity, as well known, is controlled by the relationship $\nu=c/\sqrt{\epsilon}$ wherein c=the speed of light; and $\epsilon$=the effective dielectric constant of the propagation medium. Using the values previously determined and assuming a center frequency of about 3 GHz and assuming that the phase shifter 10 is fabricated on an alumina substrate about 0.13 centimeters thick, $\epsilon=6.7$ and the propagation velocity $\nu=0.35$. Therefore, for this example, $Z_2l=25\Omega$-cm. From these calculations it is observed that the impedance and the physical length of the second transmission path 32 are interdependent and can therefore be chosen as desired. That is, for a second transmission path 32 having an impedance $Z_2$ of about 50 ohms, the physical length thereof is about 0.5 centimeters. By designing the second transmission path 32 in this fashion the reentrant network 20 is entirely power, or impedance matched to the main transmission line 12 which results in minimum power reflection at the input section 14. It should be recognized that to reduce substrate area the first, second and third transmission paths 30, 32 and 34 respectively, need not be straight. In particular the second transmission path 32 may follow a meandering path, as shown in the drawing, to reduce the substrate area occupied by the phase shifter.

One result of designing the second transmission path 32 according to the formula discussed above is that the second transmission path 32 is in a resonance condition with the capacitance of the diodes 36A and 36B at the center frequency and thus reduces the energy storage capability of the reentrant network 20 to a negligible level. By reducing the energy storage capability of the reentrant network 20 to a negligible level the passband of the phase shifter 10 is substantially unchanged regardless of the state of the diodes 36A and 36B. The capacitance of the diodes 36A and 36B is, of course, inversely related to the phase shift of the diodes 36A and 36B, i.e. the $\Delta\phi_D$. Hence, the capacitive effect of the diodes 36A and 36B is included in the constant K. In contrast to the negligible energy storage capability of the phase shifter 10 one may, under certain circumstances; such as in the design of a passband filter, desire a fairly large and significant energy storage capability in a reentrant network. One such passband filter design, wherein a fairly large energy storage capability in a reentrant network is desired, is fully described in the pending U.S. patent application Ser. No. 035,070 filed on May 1, 1979, by the same inventor and having the same assignee as named herein.

By way of example, the main transmission line 12 and the reentrant network 20 may be formed of a layer 46 of molybdenum about 200 A thick in contact with the substrate 24 and a second layer 48 of gold about 13 micrometers thick on the layer 46 of molybdenum. The width of the main transmission line 12 is about 0.12 centimeters to yield an impedance of about 50 ohms. The first and third transmission paths 30 and 34 respectively of the reentrant network 20, in this instance, are about 0.19 centimeters wide and have an impedance of about 35 ohms. The second transmission path 32, as discussed above, has an impedance of about 50 ohms and is about 0.12 centimeters wide.

The ground plane 26 comprises two layers, as already mentioned, each having about the same thickness as their counterpart layers 46 and 48 respectively, on the first surface 22. Preferably, substantially all of the second surface 28 has the ground plane 26 thereon. As well known in the art, the ground plane 26 of a microstrip circuit is functionally similar to the outside metal sheathing of a coaxial transmission line.

The phase shifter 10 described above can be viewed as having two operating states. In the first operating state, both diodes 36A and 36B are forward biased by source 44 and operate as short circuits, that is, each operates as a low impedance between a line (30 and 34) and the ground plane 26. In such a case, because the first and third transmission paths 30 and 34 respectively, are a quarter-wavelength long, any energy at the center frequency $f_0$ of the phase shifter $f_0$, that is, at the frequency at which paths 30 and 34 appear as quarter wavelength shorted stubs, entering these transmission paths 30 and 34 is effectively completely reflected and returned to the main transmission line 12 as if both transmission paths 30 and 34 were not present. Thus, substantially all of the energy at the center frequency $f_0$ entering the main transmission line 12 at the input section 14 is propagated to the second section 16.

In the second operating state, both diodes 36A and 36B are reverse-biased by source 44 and operate as open circuits and in this condition the phase shifter looks like a loop 30, 32, 34 in shunt with the path 18. In this state of the circuit, the circuit including the reentrant network 20 introduces a differential phase shift between the input section 14 and the output section 16 of the main transmission line 12. While the differential phase shift is primarily due to the $\Delta\phi_D$ of the diodes 36A and 36B it should be remembered that the entire reentrant network 20 is designed to provide the preselected phase shift and simultaneously to minimize power reflections in the main transmission line 12.

Figure 3:
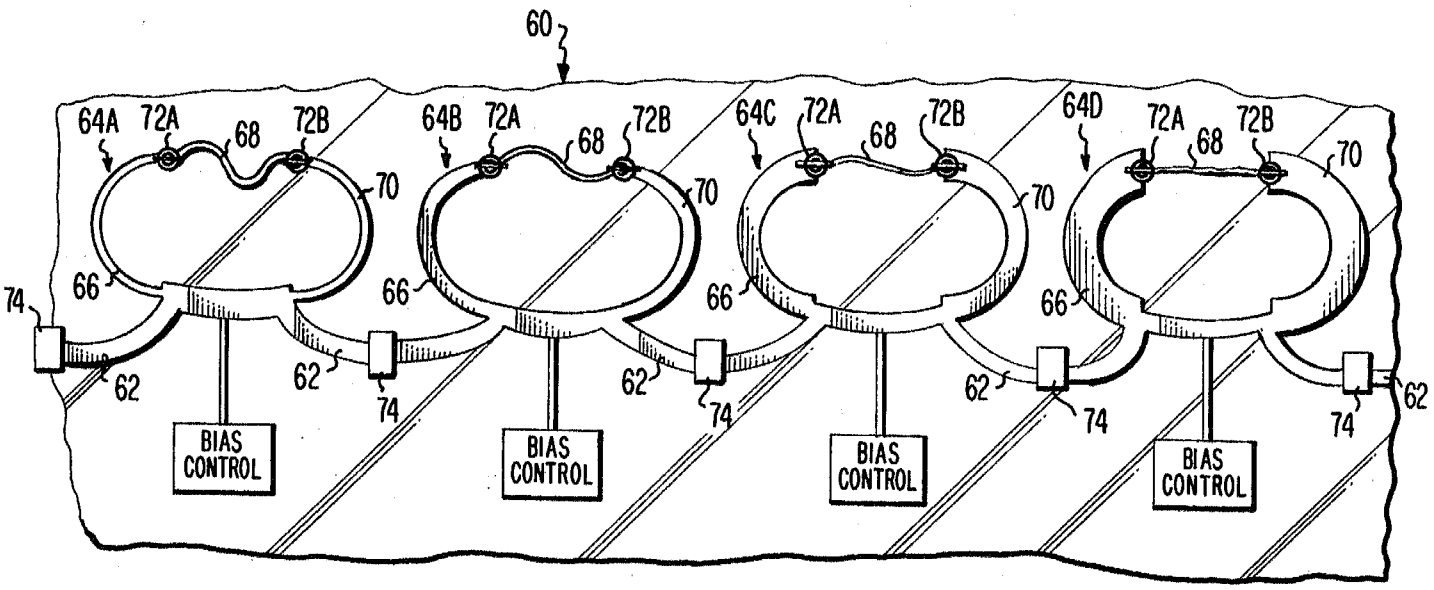
FIG. 3 is a plan view of a four bit phase shifter embodying the principles of the present invention.

Referring now to FIG. 3 which illustrates a second embodiment of the invention, phase shifter 60 is shown having a single main transmission line 62 having connected thereto a plurality of reentrant networks 64A, B, C and D. As with the phase shifter 10 shown in FIG. 1, each reentrant network 64 of the embodiment shown in FIG. 3 comprises first, second and third transmission paths, 66, 68 and 70 respectively, with a pair of diodes 72A and 72B similarly positioned. In the embodiment, each reentrant network 64 is separated from each other reentrant network 64 by a D.C. blocking capacitor 74 so that each reentrant network 64 can be separately controlled.

In a particular example, the phase shifter 60 has four reentrant networks 64A 64B, 64C and 64D. Each reentrant network 64 provides a different phase shift to a signal propagating in the main transmission line 62. For example, reentrant network 64A can provide a $\Delta\phi$ of about 22.5°, the reentrant network 64B can provide a $\Delta\phi$ of about 45° and reentrant networks 64C and 64D provides $\Delta\phi$'s of 90° and 180° respectively. As readily obserable from FIG. 3 the impedance of the first and third transmission paths 66 and 70 decrease as the phase shift of the bit increases. In addition, if the impedance of the second transmission path 68 of the reentrant networks 64 is maintained at one value for the four bits, its length decreases as the phase shift of each bit increases.

The total phase shift measured across the phase shifter 60 is equal to the sum of the individual differential phase shifts of the reentrant networks 64A, B, C, and D which are switched into the circuit. That is, if, for example, the diodes 72A and 72B associated with the reentrant network 64A having a differential phase shift of about 22.5° are open with respect to the ground plane, there would be a 22.5° differential phase shift across the entire phase shifter 60. If, in addition, the diodes 72A and 72B associated with the reentrant network 64B having a differential phase shift of about 45° are also open with respect to the ground plane, then the overall differential phase shift through the phase shifter 60 would be about 62.5°. Therefore, by judiciously selecting the phase shift of each bit the four bit phase shifter 60 can effectively provide a total phase shift of 360° which provides a phased array with sixteen incremental scanning steps.

One of the major advantages of utilizing phase shifters embodying the principles of the present invention is a significantly reduced cost since only two diodes are required per bit compared to four diodes required in conventional diode phase shifters. Another advantage is that the overall size of the phase shifter is reduced by use of a reentrant network instead of a completely alternative phase delay path.

What is claimed is:

1. A phase shifter adapted to operate at a preselected center frequency $f_0$ comprising:

an input section of transmission line to which a signal may be applied;

a second section of transmission line;

a newtork coupled between said input and said second sections, said network comprising:

a third section of transmission line matched in impedance to the input and second sections and coupling said input section to said second section;

a reentrant transmission line network having substantially negligible energy storage capacity in shunt with said third section of transmission line and;

means for switching said reentrant transmission line network between a first condition in which it appears like an open circuit to said input section and a second condition for introducing a differential phase shift to a signal propagating in said main transmission line.

2. A phase shifter as claimed in claim 1 wherein said reentrant transmission line network comprises first, second and third transmission paths connected in series with one another in the order named, said first and said third transmission paths being connected at one end to spaced points along said third section, and at their other end to opposite ends of said second path, said first and third paths each having a length of substantially ($n\lambda/4$) where n is an odd integer and $\lambda$ is the wavelength of said center frequency, wherein said means for switching comprises first and second controllable differential phase shift means connected between said other end of said first and third paths, respectively, and a point of reference potential and wherein said second path is dimensioned such that it produces a resonance condition with said first and second controllable phase shift means at said frequency $f_0$.

3. A phase shifter as claimed in claim 2 wherein said controllable differential phase shift means comprise diodes which are poled in the same direction.

4. A phase shifter as claimed in claim 3 wherein said first and third transmission paths have an impedance defined by the formula:

$$Z_{1,3}=Z_m\sqrt{K/2}$$

wherein:

$Z_{1,3}$ = the impedance of the first or third transmission path;

$Z_m$ = the impedance of said input section of transmission line; and $K=\Delta\phi/\Delta\phi_D$ wherein:

$\Delta\phi$ is the phase shift of said phase shifter; and $\Delta\phi_D$ is the differential phase shift of said diodes.

5. A phase shifter as claimed in claim 4 wherein said second transmission path has an impedance and length defined by the formula:

$$Z_2l=(Z_m\nu K/\omega_0)$$

wherein:

$Z_2l$ = the product of the impedance and the length of said second path;

$Z_m$ = the impedance of said input section of transmission line;

$\nu$ = the propagation velocity of a said second transmission path; and $\omega_0=2\pi f_0$ wherein: $f_0$ = said center frequency.

6. A phase shifter as claimed in claim 3 wherein said diodes comprise PIN diodes.

7. A phase shifter as claimed in claim 2 where said switching means comprises:

a first diode connected between said other end of said first transmission path and ground;

a second diode connected between said other end of said third transmission path and ground; and means for concurrently controlling the operating states of said diodes so that both of said diodes are in the same operating state.

8. A phase shifter as claimed in claim 1 wherein said phase shifter comprises:

a plurality of said networks.

9. A phase shifter as claimed in claim 8 wherein each said reentrant transmission line network comprises first, second and third transmission paths connected in series with one another in the order named, said first and said third transmission paths being connected at one end to spaced points along said third section, and at their other end to opposite ends of said second path, said first and third paths each having a length of substantially ($n\lambda/4$) where n is an odd integer and $\lambda$ is the wavelength of said center frequency, and wherein said means for switching comprises first and second controllable differential phase shift means connected between said other end of said first and third paths, respectively, and a point of reference potential.

10. A phase shifter as claimed in claims 8 or 9 wherein each said controllable differential phase shift means comprise diodes which are poled in the same direction.

11. A phase shifter as claimed in claim 10 wherein each said first and third transmission path has an impedance defined by the formula:

$$Z_{1,3}=Z_m\sqrt{K/2}$$

wherein:

$Z_{1,3}$ = the impedance of the first or third transmission path;

$Z_m$ = the impedance of said input section of transmission line; and $K=\Delta\phi/\Delta\phi_D$ wherein:

$\Delta\phi$ is the phase shift of said phase shifter; and $\Delta\phi_D$ is the differential phase shift of said diodes.

12. A phase shifter as claimed in claim 11 wherein each said second transmission path has an impedance and length defined by the formula:

$$Z_2l=(Z_m\nu K/\omega_0)$$

wherein:

$Z_2l$ = the product of the impedance and the length of said second path;

$Z_m$ = the impedance of said input section of transmission line;

$\nu$ = the propagation velocity of a said second transmission path; and $\omega_0=2\pi f_0$ wherein: $f_0$ = said center frequency.

13. A phase shifter as claimed in claim 9 wherein each said switching means comprises:

a first diode connected between said other end of said first transmission path and ground;

a second diode connected between said other end of said third transmission path and ground; and means for concurrently controlling the operating states of said diodes so that both of said diodes are in the same operating state.

14. A phase shifter as claimed in claims 1 or 8 wherein:

said phase shifter is a microstrip circuit.

* * * * *

UNITED STATES PATENT AND TRADEMARK OFFICE
CERTIFICATE OF CORRECTION

PATENT NO. : 4,238,745

DATED : December 9, 1980

INVENTOR(S) : Alfred Schwarzmann

It is certified that error appears in the above-identified patent and that said Letters Patent is hereby corrected as shown below:

Column 3, line 12, "$\frac{Z_2\omega_0 l}{K\nu}$" should be --$\frac{Z_2\omega_0 \ell}{K\nu}$--.

Column 3, line 20, "l" should be --$\ell$--.

Column 3, line 27, sentence beginning "Using" should begin at left margin with no indention.

Column 3, line 33, "$Z_2 l$" should be-$Z_2 \ell$-.

Column 4, line 8, "A" should be --Å--.

Column 6, line 33 (Claim 5), "$Z_2 l$" should be --$Z_2 \ell$--.

Column 6, line 36 (Claim 5), "$Z_2 l$" should be --$Z_2 \ell$--.

Column 8, line 1 (Claim 12), "$Z_2 l$" should be --$Z_2 \ell$--.

Column 8, line 4 (Claim 12), "$Z_2 l$" should be --$Z_2 \ell$--.

Signed and Sealed this

Twelfth Day of May 1981

[SEAL]

Attest:

RENE D. TEGTMEYER

Attesting Officer

Acting Commissioner of Patents and Trademarks